US007429824B2

(12) United States Patent
Lee et al.

(10) Patent No.: US 7,429,824 B2
(45) Date of Patent: Sep. 30, 2008

(54) PLASMA DISPLAY PANEL ELECTRODE SYSTEM

(75) Inventors: Tae-Ho Lee, Suwon-si (KR); Min-Sun Yoo, Suwon-si (KR); Eui-Jeong Hwang, Suwon-si (KR)

(73) Assignee: Samsung SDI Co., Ltd., Gyeonggi-Do (KR)

( * ) Notice: Subject to any disclaimer, the term of this patent is extended or adjusted under 35 U.S.C. 154(b) by 249 days.

(21) Appl. No.: 11/288,581

(22) Filed: Nov. 29, 2005

(65) Prior Publication Data

US 2006/0113913 A1 Jun. 1, 2006

(30) Foreign Application Priority Data

Nov. 30, 2004 (KR) ..... 10-2004-0098975

(51) Int. Cl.
*H01J 17/49* (2006.01)

(52) U.S. Cl. ..... 313/585; 313/584; 313/583

(58) Field of Classification Search ..... 313/583–585
See application file for complete search history.

(56) References Cited

U.S. PATENT DOCUMENTS 6,031,329 A * 2/2000 Nagano ..... 313/582
6,531,819 B1 * 3/2003 Nakahara et al. ..... 313/584
6,545,405 B1 * 4/2003 Shino et al. ..... 313/491
6,628,075 B1 * 9/2003 Kim ..... 313/586
6,734,626 B2 * 5/2004 Yoshioka et al. ..... 313/585
6,741,031 B2 * 5/2004 Harada et al. ..... 313/582
6,791,263 B2 * 9/2004 Su et al. ..... 313/582
7,106,278 B2 * 9/2006 Kim et al. ..... 345/60
7,135,819 B2 * 11/2006 Kang et al. ..... 313/584
7,230,379 B2 * 6/2007 Kwon et al. ..... 313/583
2001/0024092 A1 * 9/2001 Kim et al. ..... 313/585
2002/0008475 A1 * 1/2002 Yoshioka et al. ..... 313/586
2003/0132709 A1 * 7/2003 Harada et al. ..... 313/582
2004/0189201 A1 * 9/2004 Kang et al. ..... 313/584
2005/0082978 A1 * 4/2005 Kwon et al. ..... 313/583

* cited by examiner

*Primary Examiner*—Peter Macchiarolo
(74) *Attorney, Agent, or Firm*—Knobbe Martens Olson & Bear LLP

(57) ABSTRACT

A plasma display panel including address electrodes extending in a first direction, and scanning and sustain electrodes extending in a second direction, the electrodes corresponding to discharge cells. Each of the scanning and sustain electrodes includes a transparent electrode that extends toward the other of the scanning and sustain electrode, and over the discharge cell; a main bus electrode positioned adjacent to and parallel with a barrier rib member; and a sub-bus electrode disposed between the main bus electrode and the other of the scanning and sustain electrode. Some embodiments also include an intermediate electrode disposed between the scanning and sustain electrodes. Embodiments of the disclosed plasma display panel exhibit a reduced voltage drop over the transparent electrodes of the sustain electrodes and scanning electrodes, thereby permitting the generation of a sustain discharge at a lower voltage, and a reduced time for generating an address discharge light.

21 Claims, 9 Drawing Sheets

PLASMA DISPLAY PANEL ELECTRODE SYSTEM

CROSS-REFERENCE TO RELATED APPLICATION

This application claims priority to and the benefit of Korean Patent Application No. 10-2004-0098975 filed in the Korean Intellectual Property Office on Nov. 30, 2004, the entire content of which is incorporated herein by reference.

BACKGROUND OF THE INVENTION

1. Technical Field

The present invention relates to a plasma display panel, and more particularly, to a plasma display panel with a reduced voltage drop over the sustain electrodes and scanning electrodes.

2. Discussion of Related Technologies

In general, a plasma display panel (hereinafter, referred to as a "PDP") displays images using a plasma generated by an electrical discharge within a suitable gas. A PDP typically has good display characteristics, such as a high resolution, high brightness, high contrast, a reduction in residual images (ghosting), and a wide viewing angle.

Typically, a front substrate having sustain electrodes and scanning electrodes formed thereon is bonded to a rear substrate having address electrodes formed thereon. Barrier ribs interposed between the front and rear substrates form a plurality of discharge cells, which are typically filled with an inert gas suitable for generating a plasma, for example, a mixture of neon (Ne) and xenon (Xe).

An address discharge in a discharge cell occurs when an address voltage is applied to the address electrode and scanning pulses are applied to the scanning electrode, thereby forming wall charges between the two electrodes, and selecting a discharge cell to-be-turned-on.

When sustain pulses are applied to the sustain electrodes and the scanning electrodes after an address discharge, electrons and ions formed on the sustain electrodes and the scanning electrodes move between the sustain electrodes and the scanning electrodes, thereby generating a voltage therebetween. As a result, when the sum of the voltage generated by the electrons and ions and the wall voltage generated by the address discharge is larger than a breakdown voltage, a sustain discharge occurs in the selected discharge cells.

Subsequently, vacuum ultraviolet rays generated in the discharge cells by the sustain discharge excite a phosphor layer. The electronically excited phosphor layer relaxes to a lower energy state, thereby emitting visible light, thereby forming the images displayed on the PDP.

Typically, each of the sustain electrodes and the scanning electrodes comprises a transparent electrode, which generates the sustain discharge in the discharge cell, and a bus electrode, which applies a voltage to the transparent electrode.

The bus electrode is generally a highly conductive metallic material, which is opaque. Therefore, in order to reduce shielding of visible light generated by the discharge cells, the bus electrode is typically formed above a barrier rib, which is a non-discharge region.

However, the sustain electrodes and the scanning electrodes each comprise a transparent electrode, which typically has a lower conductivity than the bus electrode. Therefore, a large voltage drop occurs across the transparent electrode, between a back end proximal to the bus electrode, and a front end distal to the bus electrode and near the center of the discharge cell. This voltage drop also increases the time required for generating an address discharge light.

As the size of a PDP increases, the length of each bus electrode also increases. A longer bus electrode translates into an increased voltage drop over the length of the bus electrode. Therefore, the overall voltage drop at the front end of the transparent electrode also increases with increasing display size.

Consequently, the related art exhibits at least two problems: higher voltages required to achieve a sustain discharge because of the voltage drops over the transparent electrodes and bus electrodes, and extended times required for generating an address discharge.

SUMMARY OF CERTAIN INVENTIVE ASPECTS

Embodiments of the present invention provide a plasma display panel featuring a reduced voltage drop over the sustain electrodes and the scanning electrodes, thereby permitting the generation of a sustain discharge at a lower sustain voltage, and a reduced time for generating an address discharge light.

According to an aspect of the invention, a plasma display panel includes a first substrate; a second substrate; barrier ribs disposed between the first and second substrates defining a discharge cell; an address electrode extending in a first direction; a scanning electrode extending in a second direction, at least a portion of which is disposed above the discharge cell; and a sustain electrode extending in a second direction, at least a portion of which is disposed above the discharge cell. The first direction intersects the second direction. Each of the scanning electrode and sustain electrode comprises a transparent electrode comprising a back edge proximal to a barrier rib and a front edge proximal to the other of the scanning electrode or sustain electrode; a main bus electrode extending in the second direction and in electrical contact with the transparent electrode, and a sub-bus electrode extending in the second direction, disposed on or near the front edge of the transparent electrode, and in electrical contact with the transparent electrode.

In some preferred embodiments, at least one of the main bus electrode or the sub-bus electrode is disposed on a face of the transparent electrode that is proximal to the discharge cell.

In some preferred embodiments, the barrier ribs comprise first barrier rib members extending in the first direction, and second barrier rib members extending in the second direction, thereby defining a plurality of discharge chambers. The plasma display panel further comprises a plurality of address electrodes extending in the first direction; a plurality of scanning electrodes extending in the second direction; and a plurality of sustain electrodes extending in the second direction. Some embodiments of this configuration reduce crosstalk between adjacent discharge cells.

In some preferred embodiments, at least one of the main bus electrodes is adjacent to and parallel with a second barrier rib member, and positioned above a discharge cell. Preferably, at least one of the main bus electrodes is wider than at least one of the sub-bus electrodes. This configuration reduces shielding of visible light emitted from the center of discharge cell, and reduces voltage drop across the transparent electrode.

In some preferred embodiments, the scanning electrodes and the sustain electrodes alternate along the first direction.

In some preferred embodiments, at least one of the main bus electrodes is positioned substantially above a second barrier rib member. In some embodiments, at least one of the main bus electrodes is wider than at least one of the sub-bus electrodes. Some of these embodiments reduce the shielding of visible light emitted from the discharge cell by the sub-bus electrode.

Furthermore, in some embodiments, at least some of the electrodes are arranged in the second direction in the following order: a scanning electrode, an intermediate electrode, two sustain electrodes, an intermediate electrode, and a scanning electrode.

According to another aspect of the invention, the plasma display panel further comprises at least one intermediate electrode extending in the second direction. The intermediate electrode is disposed between a scanning electrode and a sustain electrode, and is positioned above at least one discharge cell. In some embodiments, at least one intermediate electrode comprises a transparent electrode extending in the second direction, and a bus electrode extending in the second direction and in electrical connection with the transparent electrode. In some embodiments, of the intermediate electrode, the bus electrode is disposed on a surface of the transparent electrode that is proximal to the discharge cell.

In some preferred embodiments, the scanning electrodes, the sustain electrodes, and the intermediate electrodes form a repeat unit in the first direction comprising a scanning electrode, an intermediate electrode, two sustain electrodes, an intermediate electrode, and a scanning electrode. Preferably, at least one main bus electrode is shared by a pair of scanning electrodes or a pair of sustain electrodes, wherein at least a portion of each electrode of the pair of scanning electrodes or the pair of sustain electrodes is disposed above a different discharge cell, and the discharge cells are adjacent in the first direction.

Preferably, the scanning electrode and the sustain electrode are covered with a dielectric layer and a MgO film.

In some embodiments, the scanning electrode and the sustain electrode contact the second substrate. In some embodiments, the intermediate electrode contacts the second substrate. In some embodiments, the address electrode contacts the first substrate.

Also provided is plasma display panel comprising at least one discharge cell; and a pair of substantially parallel elongate display electrodes, at least a portion of each which is disposed above the at least one discharge cell. Each of the display electrodes comprises a transparent electrode extending over the at least one discharge cell; an elongate main bus electrode in electrical contact with the transparent electrode comprising an elongate axis substantially parallel with elongate axes of the display electrodes; and a means in electrical contact with the transparent electrode for reducing a voltage drop over the transparent electrode.

Also provided is a plasma display comprising: a discharge cell; and a first pair of display electrodes. At least one of the first pair of display electrodes comprises: a transparent electrode comprising a back edge proximal to a wall of a discharge cell, a front edge proximal to the other of the pair of display electrodes, and a face proximal to the discharge cell; a main bus electrode extending in the second direction, disposed at or near the back edge of the transparent electrode, and in electrical contact with the transparent electrode; and a sub-bus electrode extending in the second direction, disposed at or near the front edge of the transparent electrode, and in electrical contact with the transparent electrode.

In some embodiments, the main bus electrode and sub-bus electrode are disposed on the face of the transparent electrode. In some embodiments, the main bus electrode is wider than the sub-bus electrode. In some embodiments, the main bus electrode and the sub-bus electrode comprise a metal, and the transparent electrode comprises indium tin oxide.

Some preferred embodiments further comprise a second pair of display electrodes, wherein one of the first pair of display electrodes and one of the second pair of display electrodes are integrated. In some embodiments, the integrated electrodes share a main bus electrode.

Some preferred embodiments further comprise an intermediate electrode extending in the second direction and disposed between the first pair of display electrodes. In some embodiments, the intermediate electrode comprises a transparent electrode extending in the second direction and comprising a face proximal to the first discharge cell; and a bus electrode extending in the second direction, disposed on the face of the transparent electrode, and in electrical contact with the transparent electrode. Some preferred embodiments further comprise a second pair of display electrodes, wherein one of the first pair of display electrodes and one of the second pair of display electrodes are integrated. In some embodiments, the integrated electrodes share a main bus electrode.

BRIEF DESCRIPTION OF THE DRAWINGS

The above and other objects, features, and other advantages of the present invention will be more clearly understood from the following detailed description taken in conjunction with the accompanying drawings, in which.

DETAILED DESCRIPTION OF EMBODIMENTS

Figure 1:
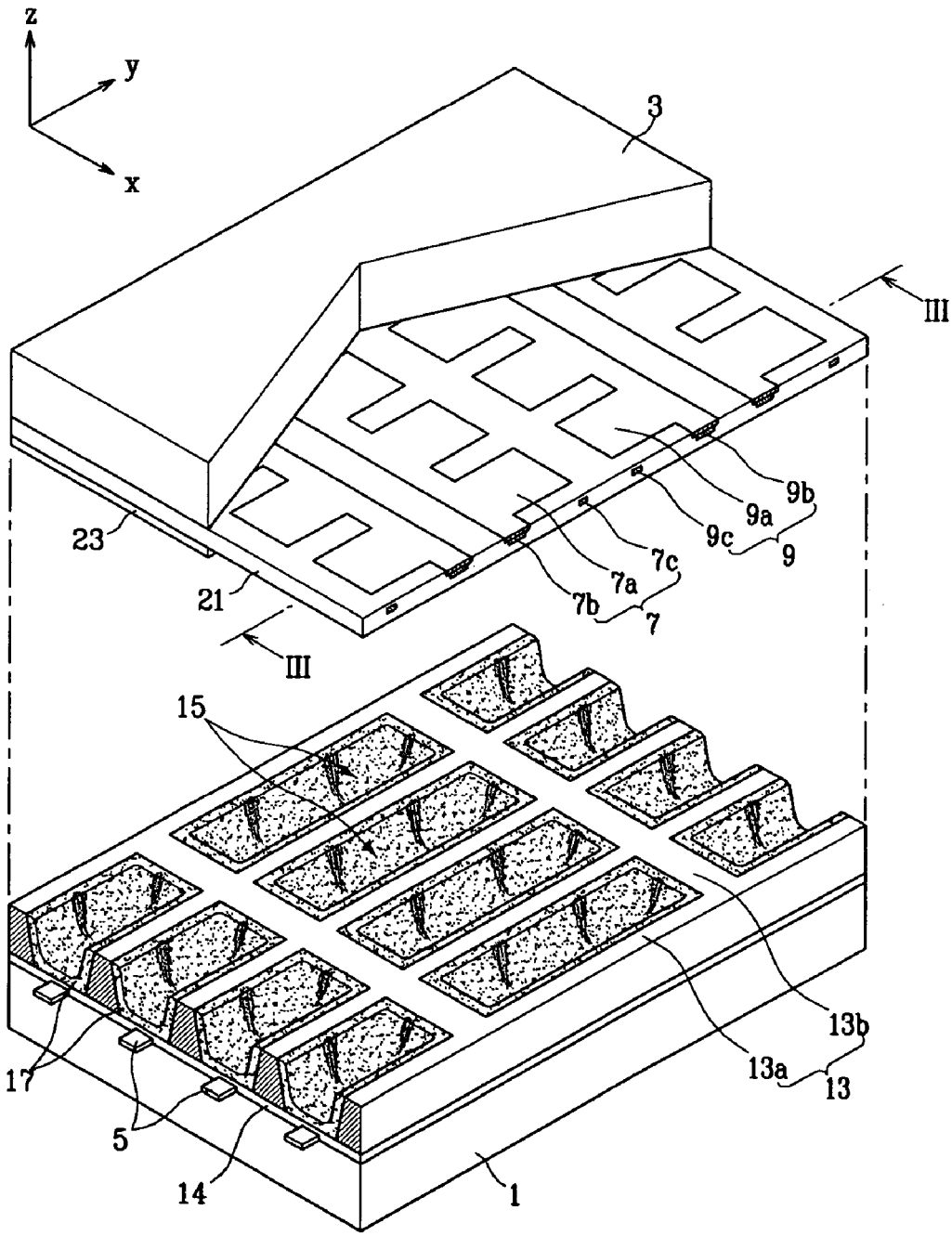
FIG. 1 is a partially exploded perspective view showing a plasma display panel according to a first embodiment of the invention.

Hereinafter, some preferred embodiments of the invention will be described in detail with reference to the accompanying drawings so that those skilled in the art can easily practice the invention. In addition, various changes and modifications can be made without departing from the spirit and scope of the invention, and the invention is not limited to the preferred embodiments. In the drawings, in order to clearly describe the invention, components not related to the description of the invention are not shown, and the same or similar components have the same reference numerals. The drawings are not necessarily to scale.

Figure 2:
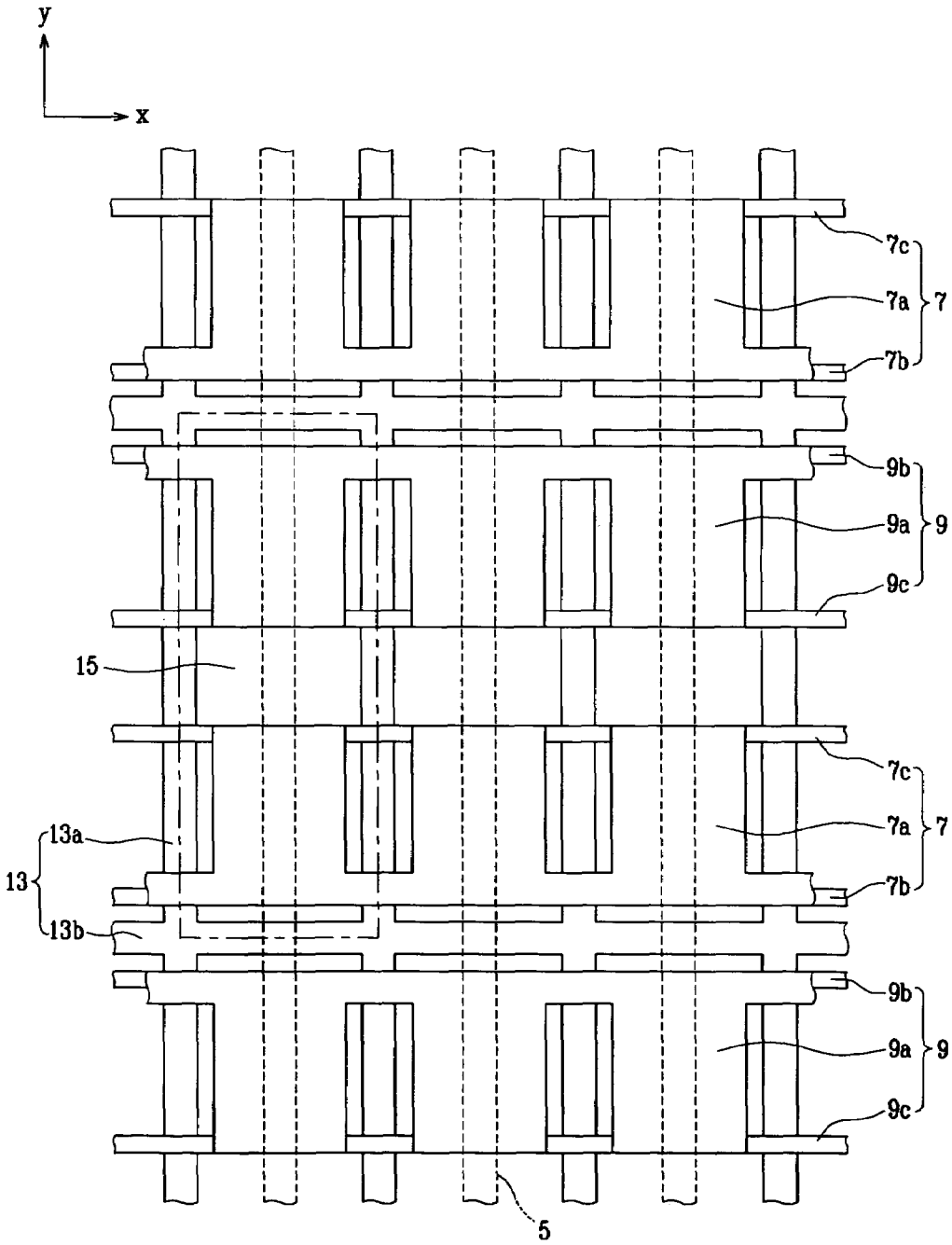
FIG. 2 is a partial plan view illustrating the arrangement relationship between barrier ribs and electrodes of the plasma display panel shown in FIG. 1.
Figure 3:
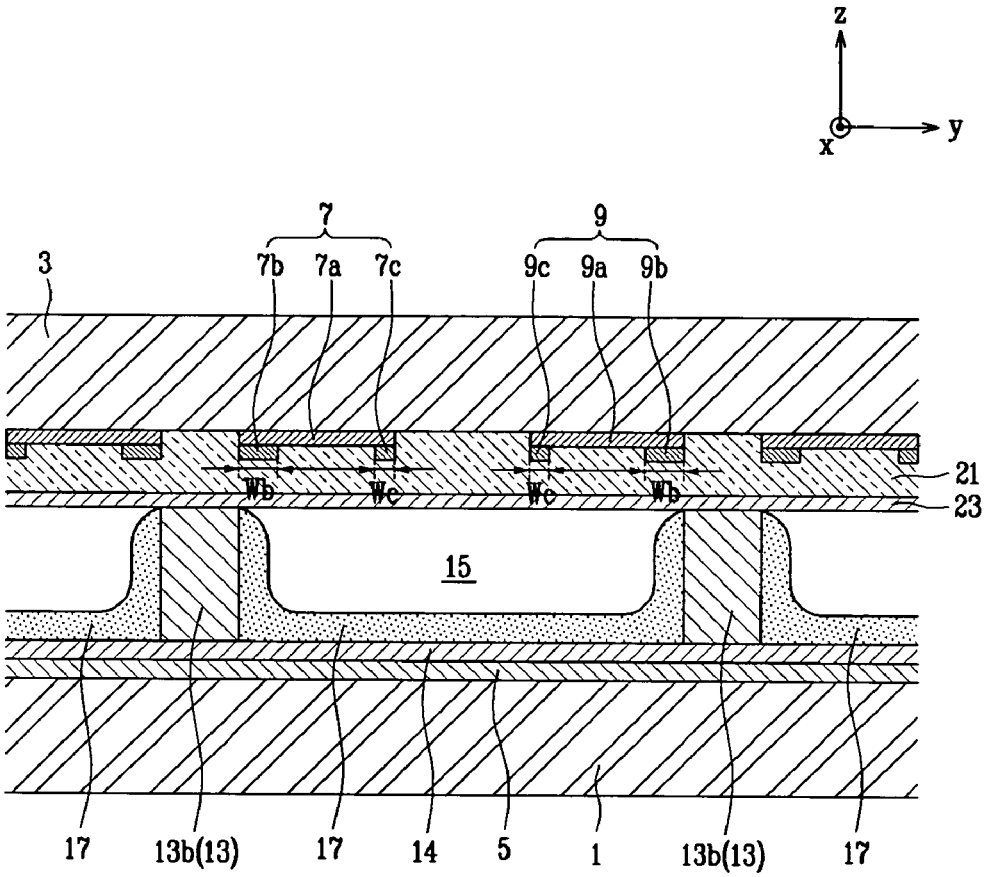
FIG. 3 is a cross-sectional view taken along the line III-III of the plasma display panel formed by bonding a front substrate to a rear substrate shown in FIG. 1.

FIG. 1 is a partially exploded perspective view schematically showing a plasma display panel in accordance with a first embodiment of the invention. FIG. 2 is a partial plan view illustrating the arrangement of barrier ribs and electrodes of the plasma display panel shown in FIG. 1, and FIG. 3 is a cross-sectional view of the assembled plasma display panel shown in FIG. 1, taken along the line III-III of FIG. 1.

The plasma display panel will be described with reference to these drawings. The plasma display panel according to this embodiment includes a first substrate 1 (hereinafter, referred to as a "rear substrate") and a second substrate 3 (hereinafter, referred to as a "front substrate") that face each other with a predetermined gap therebetween.

A plurality of address electrodes 5 extend in a first direction (y-axis direction) on the rear substrate 1. The plurality of address electrodes 5 are arranged at predetermined intervals in a second direction (x-axis direction).

First electrodes 7 (hereinafter, referred to as "sustain electrodes") and second electrodes 9 (hereinafter, referred to as "scanning electrodes") are arranged on the front substrate 3 in the second direction (x-axis direction), which intersects the first direction. The sustain electrodes 7 and the scanning electrodes 9 are arranged at predetermined intervals in the second (y-axis) direction. The sustain and scanning electrodes are also referred to herein as "display electrodes."

Barrier ribs 13 provided between the front substrate 3 and the rear substrate 1 form a plurality of discharge cells 15, each discharge cell 15 corresponding to an address electrode 5, a sustain electrode 7, and a scanning electrode 9.

In the illustrated embodiment, the barrier ribs 13 includes first barrier rib members 13*a* extending in the first (y-axis) direction; and second barrier rib members 13*b* extending in the second direction (x-axis direction). The first barrier rib members 13*a* and second barrier rib members 13*b* intersect, forming a plurality of discharge cells 15. In the illustrated embodiment, the barrier ribs 13 effectively prevent cross-talk between adjacent discharge cells 15.

In the illustrated embodiment, the first barrier rib members 13*a* are arranged between adjacent address electrodes 5.

In the illustrated embodiment, each second barrier rib member 13*b* is positioned between a sustain electrode 7 and a scanning electrode 9.

The first barrier rib members 13*a* and the second barrier rib members 13*b* are arranged to intersect each other between the rear substrate 1 and the front substrate 3, thereby forming a closed barrier rib structure therebetween.

The closed barrier rib structure is not limited to the rectangular array illustrated in the drawings. In other embodiments, the barrier rib structure forms a hexagonal array, an octagonal array, or an array with another shape.

A phosphor layer 17 is formed on inner surfaces of the barrier ribs 13 forming the partitioned discharge cells 15 and on a dielectric layer 14 surrounded by the barrier ribs 13.

The phosphor layer 17 emits visible light by a state transition from an excited state, formed by absorbing vacuum ultraviolet rays generated by a plasma discharge, to a lower energy state. In some embodiments, the plasma discharge is from an inert gas (for example, a mixture of neon (Ne) and xenon (Xe)) contained in the discharge cells 15, in which vacuum ultraviolet rays are generated by the plasma discharge.

In the illustrated embodiment, the sustain electrodes 7 and the scanning electrodes 9 are formed on the front substrate 3 above the discharge cells 15. The address electrodes 5 are arranged on the rear substrate 1 in a direction intersecting the sustain electrodes 7 and the scanning electrodes 9, that is, in the first (y-axis) direction. In the illustrated embodiment, the address electrodes are disposed under a dielectric layer 14.

The dielectric layer 14 protects the address electrodes 5 during plasma discharge, and stores wall charges during an address discharge.

A discharge cell 15 is selected for turning on using an address discharge, which occurs when an address voltage is applied to an address electrode 5, and scanning pulses are applied to the corresponding scanning electrode 9, thereby forming wall charges in the discharge cell 15 to-be-turned-on.

In a reset period, applying a reset rising waveform and a reset falling waveform the scanning electrodes 9 produces a reset discharge.

In a scanning period subsequent to the reset period, applying a scanning pulse waveform to the scanning electrodes 9 and a pulse waveform applied to the address electrodes 5 produces an address discharge.

In a sustain period subsequent thereto, applying a sustain voltage to the sustain electrodes 7 and the scanning electrodes 9 produces a sustain discharge.

As such, the sustain electrodes 7 and the scanning electrodes 9 are used for applying sustain pulses required for the sustain discharge. The scanning electrodes 9 are also used for applying the reset pulse waveform and the scanning pulse waveform.

However, the sustain electrodes 7 and the scanning electrodes 9 can also be used for other functions depending on the waveform of the applied voltage. In other words, the functions of the sustain electrodes 7 and the scanning electrodes 9 are not necessarily limited to the functions described above.

In the illustrated embodiment, the sustain electrodes 7 and the scanning electrodes 9 are formed on the front substrate 3 to correspond to the discharge cells, and are covered with a laminated structure comprising a dielectric layer 21 and an MgO protective film 23.

In the illustrated embodiment, each of the sustain electrodes 7 and the scanning electrodes 9 include transparent electrodes 7*a* and 9*a*, main bus electrodes 7*b* and 9*b*, and sub-bus electrodes 7*c* and 9*c*, respectively.

Without being bound by any theory, it is believed that the transparent electrodes 7*a* and 9*a* generate a surface discharge inside the discharge cell 15. Typically, of the transparent electrodes 7*a* and 9*a* comprise a transparent material such as ITO (indium tin oxide) to optimize the aperture ratio.

In the illustrated embodiment, the main bus electrodes 7*b* and 9*b* and the sub-bus electrodes 7*c* and 9*c* compensate for high electrical resistance of the transparent electrodes 7*a* and 9*a* and to optimize electrical connections in the device. Typically, the main bus electrodes 7*b* and 9*b* and the sub-bus electrodes 7*c* and 9*c* comprise a metallic material such as aluminum (Al).

The transparent electrodes 7*a* and 9*a* extend in the x-axis (second) direction, thereby corresponding to the rows of discharge cells 15 extending in the x-axis direction. In the illustrated embodiment, the transparent electrodes comprise elements, corresponding to each discharge cell 15. Each element comprises a back end proximal to a second barrier rib member 13*b*, and a front end proximal to the center of the discharge cell 15. The transparent electrodes 7*a* and 9*a* extend towards each other, forming a discharge gap therebetween.

The main bus electrodes 7*b* and 9*b* extend in a second direction (x-axis direction). In the illustrated embodiment, the main bus electrodes 7*b* and 9*b* are formed on portions of the transparent electrodes proximal to the second barrier rib members 13*b*, that is, at the back ends of the transparent electrodes 7*a* and 9*a*.

In the illustrated embodiment, the main bus electrodes 7*b* and 9*b* are formed at the inner sides of the discharge cells 15, thereby reducing the distances between the main bus electrodes 7*b* and 9*b* and front ends of the transparent electrodes 7*a* and 9*a*. In the illustrated configuration, the main bus electrodes 7*b* and 9*b* block a portion of the visible light that would otherwise be emitted from the discharge cell 15; however, the configuration reduces the voltage drop over the transparent electrodes 7*a* and 9*a*.

The illustrated embodiment also includes sub-bus electrodes 7*c* and 9*c* that are parallel to the main bus electrodes 7*b* and 9*b* and disposed on the front ends of the near the center of the discharge cell 15, that is, distal to the main bus electrodes 7*b* and 9*b* on the transparent electrodes 7*a* and 9*a*.

In the illustrated embodiment, the sub-bus electrodes 7*c* and 9*c* compensate for the voltage drop from the main bus electrodes 7*b* and 9*b* to the front ends of the transparent electrodes 7*a* and 9*a*. In some embodiments, the same voltages are applied to both the main bus electrodes 7*b* and 9*b* and the sub-bus electrodes 7*c* and 9*c*, thereby providing a substantially uniform voltage over the entire transparent electrode 7*a* or 9*a*.

Since the sub-bus electrodes 7*c* and 9*c* are positioned at or near the center of the discharge cell 15, the sub-bus electrodes 7*c* and 9*c* are preferably have widths Wc smaller than widths Wb of the main bus electrodes 7*b* and 9*b* in order to reduce the shielding of visible light by the sub-bus electrodes 7*c* and 9*c*.

Although the sub-bus electrodes 7*c* and 9*c* block some of the visible light generated by the discharge cells 15, the supplemental voltage applied to the transparent electrodes 7*a* and 9*a* permits a sustain discharge to occur at a lower voltage, thereby shortening the time required for generating an address discharge light.

As described above, the sustain electrodes 7 and the scanning electrodes 9 are disposed alternately in the first direction (y-axis direction) with a sustain electrode 7 and a scanning electrode 9 associated with each discharge cell 15.

Figure 4:
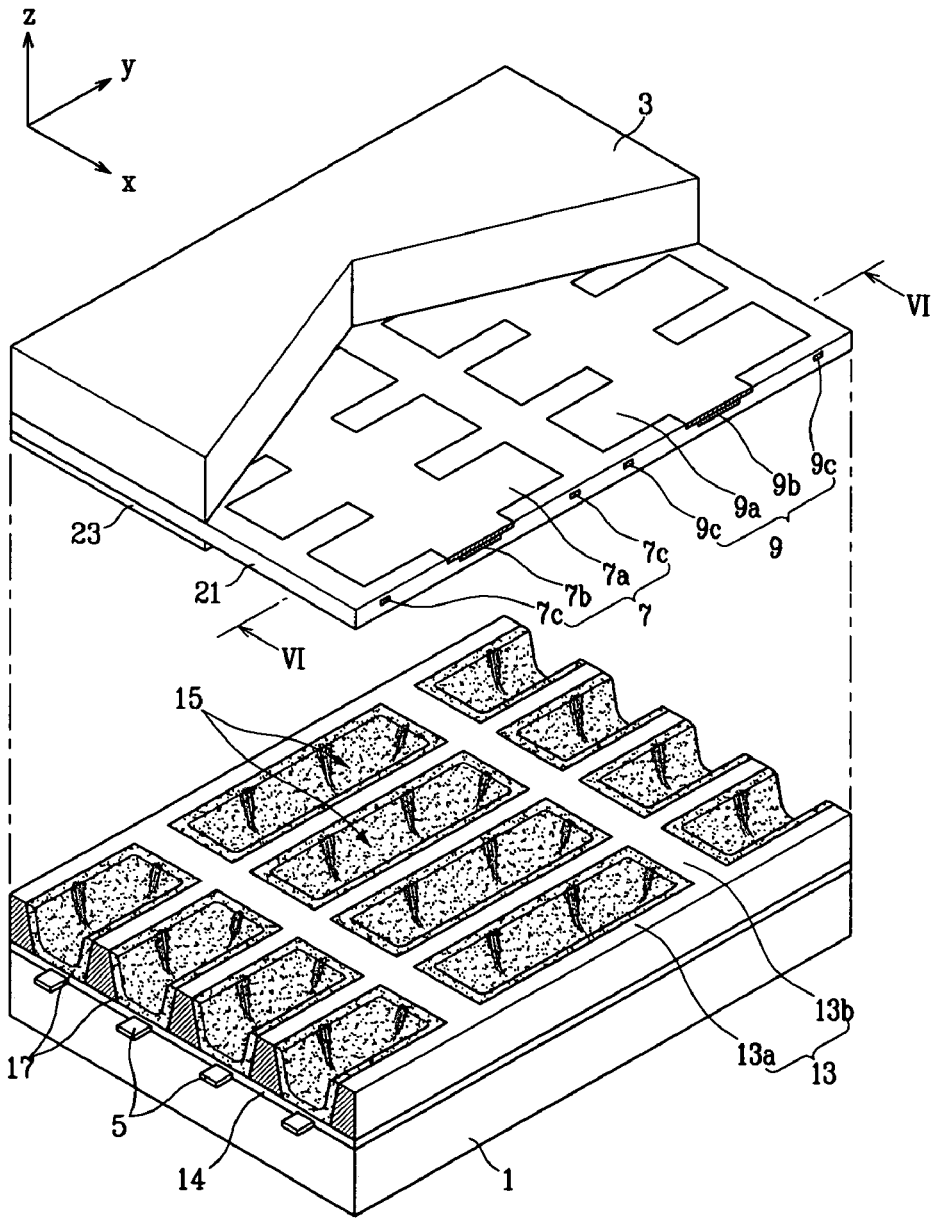
FIG. 4 is a partially exploded perspective view schematically showing a plasma display panel according to a second embodiment of the invention.
Figure 5:
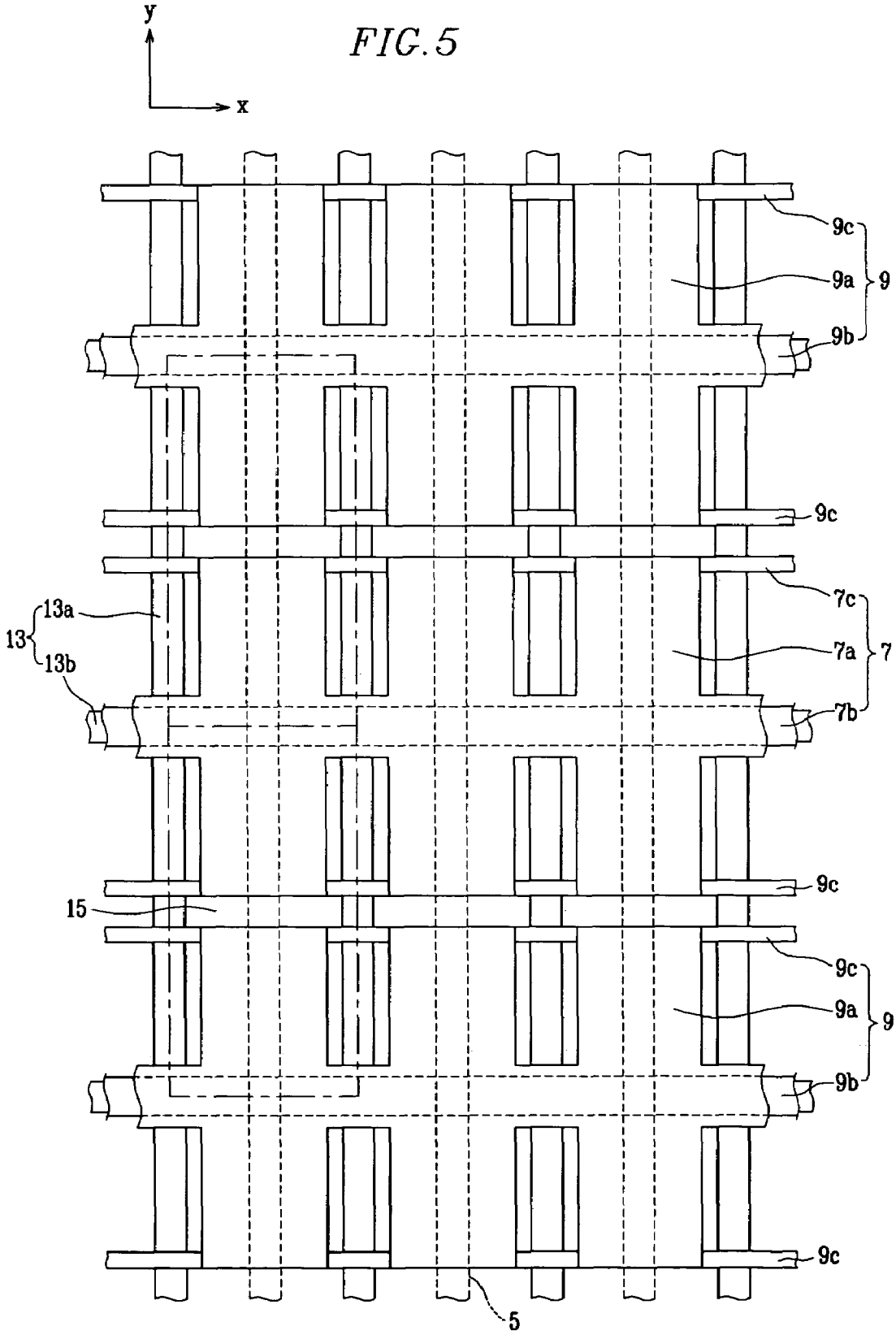
FIG. 5 is a partial plan view illustrating the arrangement relationship between barrier ribs and electrodes of the plasma display panel shown in FIG. 4.
Figure 6:
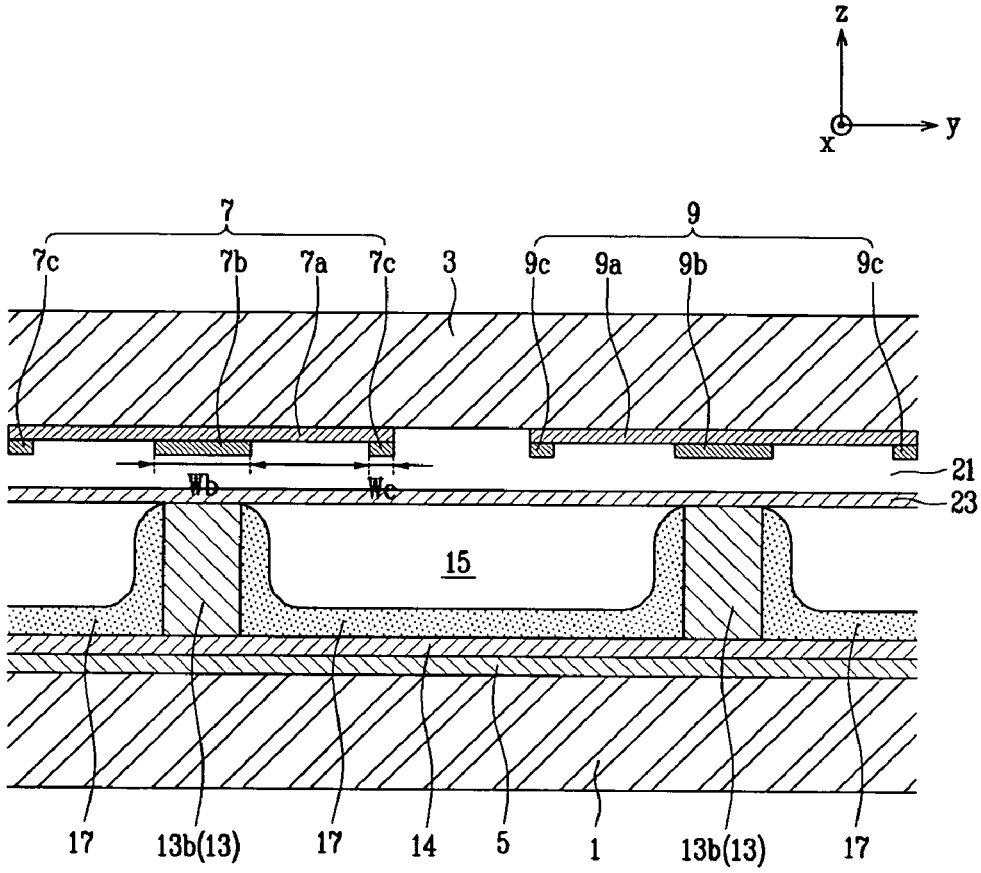
FIG. 6 is a cross-sectional view taken along the line VI-VI of the plasma display panel formed by bonding a front substrate to a rear substrate shown in FIG. 4.

FIG. 4 is a partially exploded perspective view schematically showing a plasma display panel in accordance with a second embodiment of the invention. FIG. 5 is a partial plan view illustrating the arrangement relationship between barrier ribs and electrodes of the plasma display panel shown in FIG. 4, and FIG. 6 is a cross-sectional view of the plasma display panel shown in FIG. 4, taken along the line VI-VI of FIG. 4.

The second embodiment is similar to the first embodiment in overall structure and operation. Therefore, a description will be given below of components or structures that are different from the first embodiment.

In the first embodiment, the sustain electrodes 7 and the scanning electrodes 9 are disposed alternately in the first direction (y-axis direction). However, in the second embodiment, pairs of sustain electrodes 7 alternate with pairs of scanning electrodes 9. The resulting configuration may also be described as a repeat unit comprising in order a sustain electrode, a scanning electrode, a scanning electrode, and a sustain electrode.

Therefore, in some embodiments of the second embodiment, the area of the non-discharge region is reduced compared with the first embodiment, thereby further improving luminous efficiency.

For example, in the embodiment illustrated in FIGS. 4-6, the two sustain electrodes 7 of discharge cells 15 adjacent to each other in the extending direction (y-axis direction) are integrated. Similarly, the two scanning electrodes 9 of discharge cells 15 adjacent to each other in the first direction (y-axis direction) are integrated.

In a preferred embodiment of this structure, one or both of the main bus electrodes 7*b* and 9*b* are integrated. In the illustrated embodiment, both of the main bus electrodes are formed above the second barrier rib members 13*b* defining discharge cells 15 adjacent to each other in the first (y-axis) direction. The illustrated embodiment reduces shielding by the main bus electrodes 7*b* and 9*b* of light emitted from the discharge cells 15.

In a preferred embodiment, the transparent electrodes 7*a* and 9*a* extend from the main bus electrodes 7*b* and 9*b* an equal distance towards each other, that is, have the same width.

Figure 7:
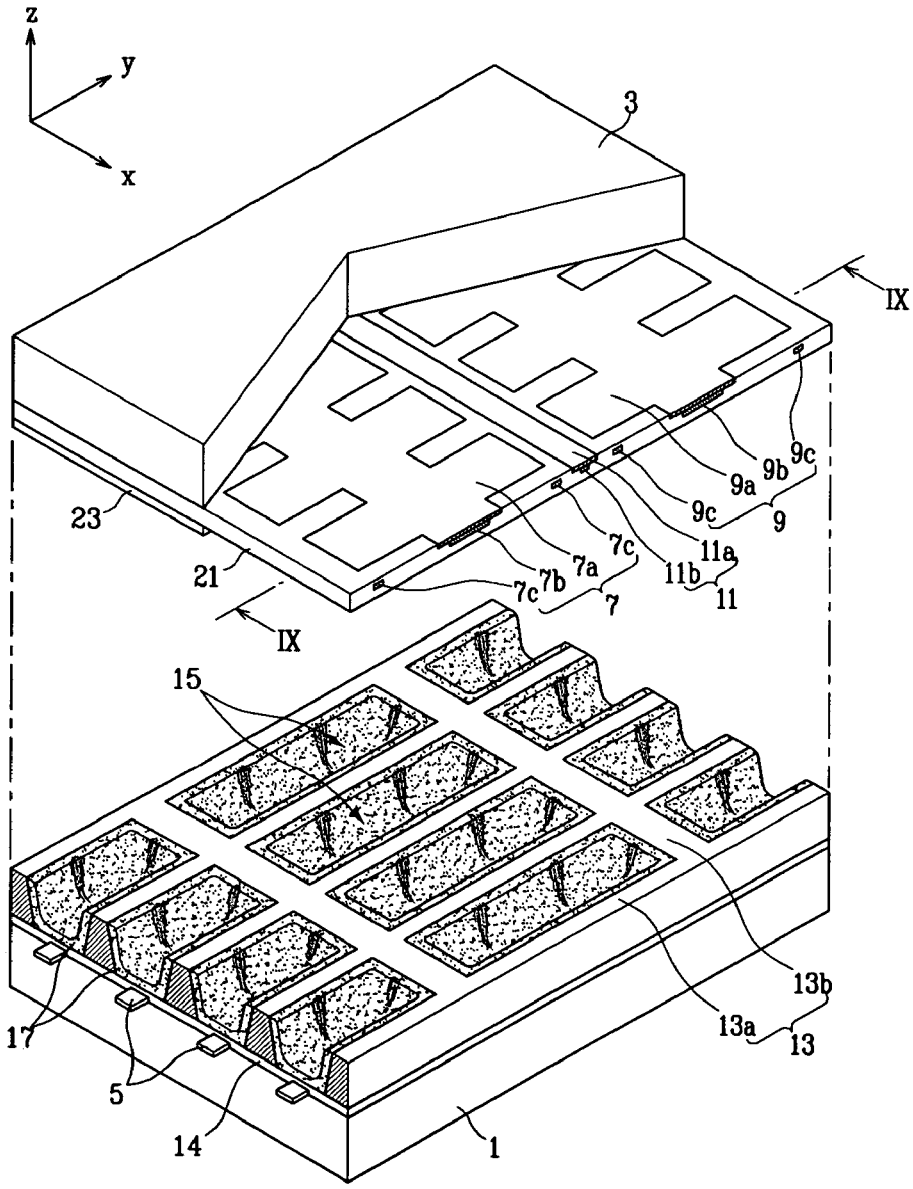
FIG. 7 is a partially exploded perspective view schematically showing a plasma display panel according to a third embodiment of the invention.
Figure 8:
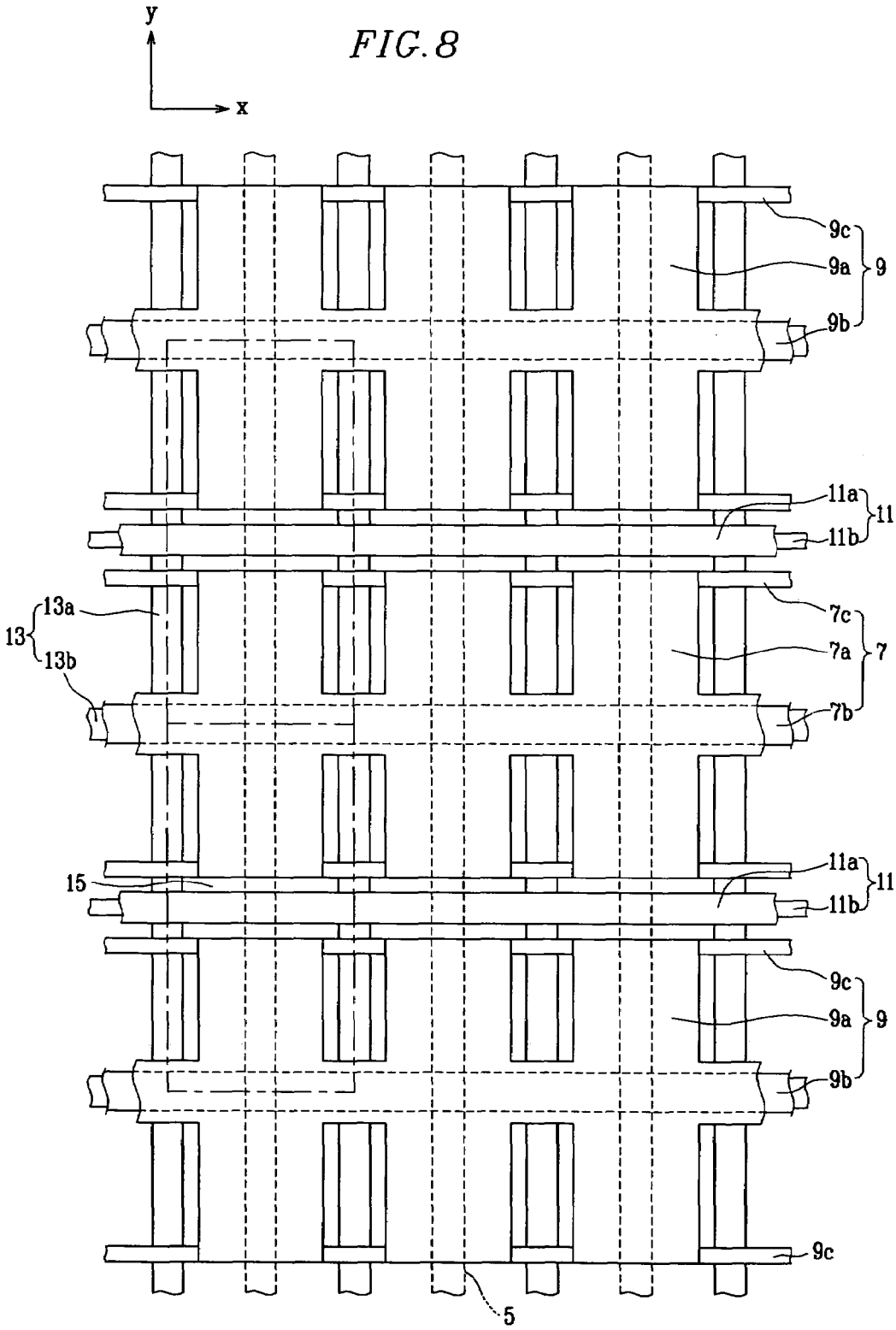
FIG. 8 is a partial plan view illustrating the arrangement relationship between barrier ribs and electrodes of the plasma display panel shown in FIG. 7.
Figure 9:
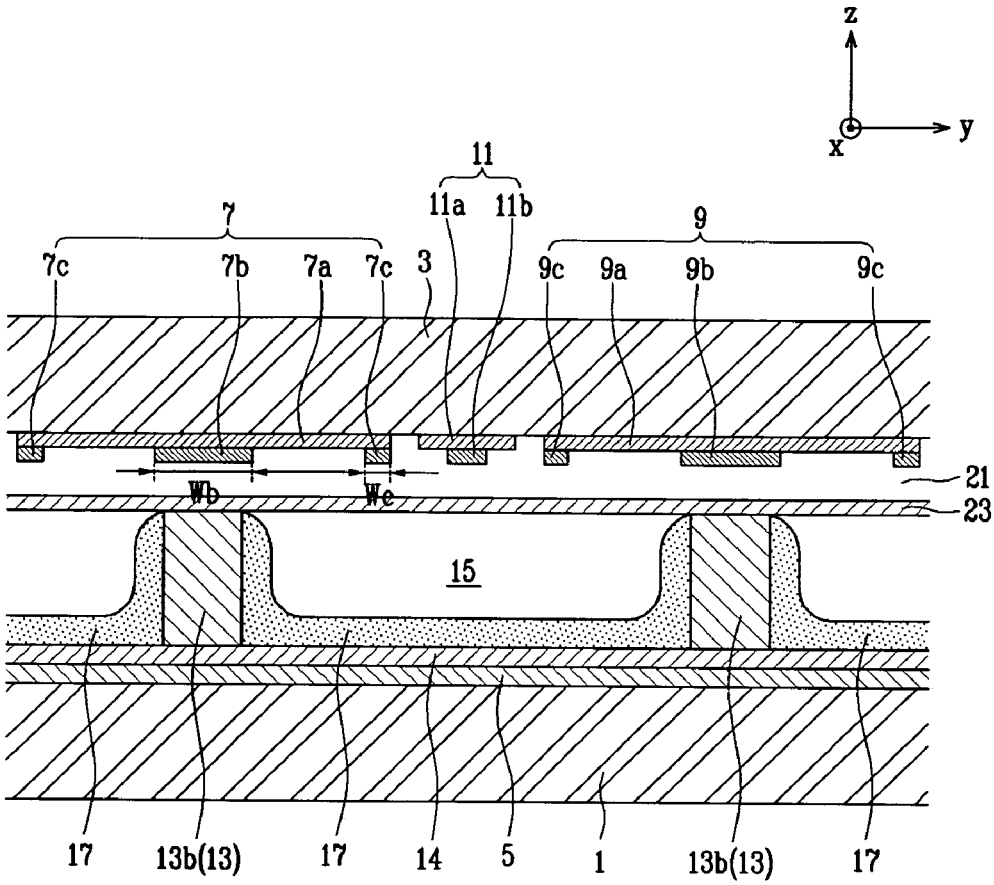
FIG. 9 is a cross-sectional view taken along the line IV-IV of the plasma display panel formed by bonding a front substrate to a rear substrate shown in FIG. 7.

FIG. 7 is a partially exploded perspective view schematically showing a plasma display panel in accordance with a third embodiment of the invention. FIG. 8 is a partial plan view illustrating the arrangement relationship between barrier ribs and electrodes of the plasma display panel shown in FIG. 7, and FIG. 9 is a cross-sectional view of the plasma display panel shown in FIG. 7, taken along the line IX-IX of FIG. 7.

The third embodiment is similar to the first and second embodiments in the overall structure and operation. Therefore, a description will be given below of components or structures that are different from the second embodiment.

The third embodiment is different from the second embodiment in that intermediate electrodes 11 are further provided between the sustain electrodes 7 and the scanning electrodes 9. In the illustrated embodiment, the intermediate electrodes 11 are substantially parallel to the sustain electrodes 7 and the scanning electrodes 9.

In the illustrated embodiment, the intermediate electrode 11 extends in the second (x-axis) direction near or at the center of the discharge cell 15, and is substantially centered between the sustain electrode 7 and the scanning electrode 9.

In embodiments comprising an intermediate electrode 11, an address discharge may be initiated by applying an address voltage to the address electrode 5 and a scanning pulse to the intermediate electrode 11. The address discharge selects the discharge cell 15 to-be-turned-on, for example, by forming wall charges in the selected discharge cell 15.

In a reset period, applying a reset rising waveform and a reset falling waveform to the intermediate electrodes 11 results in a reset discharge in the discharge cell 15.

In a scanning period subsequent to the reset period, applying a scanning pulse waveform to the intermediate electrodes 11 and a pulse waveform to the address electrodes 5 results in an address discharge in the discharge cell 15.

In a sustain period subsequent thereto, applying a sustain voltage to the sustain electrodes 7 and the scanning electrodes 9 results in a sustain discharge.

In the illustrated embodiment, a small gap is formed between the intermediate electrode 11 and the scanning electrode 9, which makes it possible to generate the sustain discharge at a low voltage at the beginning of the sustain period. In addition, the intermediate electrode 11 interposed between the sustain electrode 7 and the scanning electrode 9 forms a relatively large gap therebetween, thereby improving luminous efficiency during the sustain discharge.

The intermediate electrode 11 in the illustrated embodiment comprises a transparent electrode 11*a* and a bus electrode 11*b*. The transparent electrode 11*a* extends in the first direction (x-axis direction), at or near the center of the discharge cell 15 between the sustain electrode 7 and the scanning electrode 9. Preferably, the transparent electrode 11*a* comprises a transparent material such as ITO, as described above.

Preferably, the bus electrode 11*b* is made of a metallic material having high conductivity such as aluminum (Al), thereby supplementing the conductivity of the transparent electrode 11*a* and reducing the voltage drop over the transparent electrode 11*a*. In the illustrated embodiment, the bus electrode 11*b* is disposed on a portion of the transparent electrode 11*a* facing, that is proximal to, the discharge cell 15.

As in the second embodiment, the sustain electrodes 7 and the scanning electrodes 9, respectively, are integrated between discharge cells 15 adjacent to each other in the first (y-axis) direction, and consequently, are used in the production of the sustain discharge in adjacent discharge cells 15.

Furthermore, the intermediate electrode 11 is arranged between the sustain electrode 7 and the scanning electrode 9. In the illustrated embodiment, these electrodes 7, 9, and 11 form a repeat unit in the first (y-axis) direction comprising in order, a sustain electrode, an intermediate electrode, a scanning electrode, a scanning electrode, an intermediate electrode, and a sustain electrode.

A description has been given above of some preferred embodiments of the invention. However, the invention is not limited thereto, and it will be understood by those skilled in the art that various changes and modifications can be made without departing from the scope and spirit of the invention as defined by the following claims.

What is claimed is:

1. A plasma display panel comprising:
a first substrate;
a second substrate;
a plurality of barrier ribs disposed between the first and second substrates defining a discharge cell;
an address electrode extending in a first direction;
a scanning electrode extending in a second direction, at least a portion of which is disposed above the discharge cell; and
a sustain electrode extending in a second direction, at least a portion of which is disposed above the discharge cell,
wherein the first direction intersects the second direction,
and wherein each of the scanning electrode and sustain electrode comprises:
a transparent electrode comprising a back edge proximal to a barrier rib and a front edge proximal to the other of the scanning electrode or sustain electrode;
a main bus electrode extending in the second direction and in electrical contact with the transparent electrode; and
a sub-bus electrode extending in the second direction, physically contacting the transparent electrode at or near the front edge of the transparent electrode, and in electrical contact with the transparent electrode.

2. The plasma display panel according to claim 1, wherein at least one of the main bus electrode or the sub-bus electrode is disposed on a face of the transparent electrode proximal to the discharge cell.

3. The plasma display panel according to claim 1,
wherein the barrier ribs comprise:
first barrier rib members extending in the first direction; and
second barrier rib members extending in the second direction,
wherein the first direction and the second direction are substantially perpendicular, thereby defining a plurality of discharge chambers, the plasma display panel further comprising:
a plurality of address electrodes extending in the first direction;
a plurality of scanning electrodes extending in the second direction; and
a plurality of sustain electrodes extending in the second direction.

4. The plasma display panel according to claim 3, wherein at least one of the main bus electrodes is adjacent to and parallel with the second barrier rib member, and positioned above the discharge cell.

5. The plasma display panel according to claim 4,
wherein at least one of the main bus electrodes is wider than at least one of the sub-bus electrodes.

6. The plasma display panel according to claim 5,
wherein the scanning electrodes and the sustain electrodes alternate along the first direction.

7. The plasma display panel according to claim 3, wherein at least one of the main bus electrodes is positioned substantially above a second barrier rib member.

8. The plasma display panel according to claim 7,
wherein at least one of the main bus electrodes is wider than at least one of the sub-bus electrodes.

9. The plasma display panel according to claim 8, wherein pairs of scanning electrodes alternate with pairs of sustain electrodes along the first direction.

10. The plasma display panel according to claim 9, wherein at least one main bus electrode is shared by a pair of scanning electrodes or a pair of sustain electrodes, wherein
each electrode of the pair of scanning electrodes or a pair of sustain electrodes is disposed above a different discharge cell, and
the discharge cells are adjacent in the first direction.

11. The plasma display panel of claim 3, further comprising at least one intermediate electrode extending in the second direction, wherein
the intermediate electrode is disposed between a scanning electrode and a sustain electrode, and
the intermediate electrode is positioned above at least one discharge cell.

12. The plasma display panel according to claim 11, wherein
the at least one intermediate electrode comprises:
a transparent electrode extending in the second direction; and
a bus electrode extending in the second direction and in electrical connection with the transparent electrode of the intermediate electrode.

13. The plasma display panel according to claim 12, wherein for the at least one intermediate electrode, the bus electrode is disposed on a surface of the transparent electrode that is proximal to the discharge cell.

14. The plasma display panel according to claim 11, wherein at least some of the scanning, sustain, and intermediate electrodes are arranged in the second direction in the following order: a scanning electrode, an intermediate electrode, two sustain electrodes, an intermediate electrode, and a scanning electrode.

15. The plasma display panel according to claim 14, wherein
at least one main bus electrode is shared by a pair of the scanning electrodes or a pair of the sustain electrodes, wherein
at least a portion of each electrode of the pair of the scanning electrodes or the pair of the sustain electrodes is disposed above a different discharge cell, and
the discharge cells are adjacent in the first direction.

16. The plasma display panel according to claim 1, wherein the scanning electrode and the sustain electrode are covered with a dielectric layer and a MgO film.

17. The plasma display panel according to claim 1, wherein the scanning electrode and the sustain electrode contact the second substrate.

18. The plasma display panel according to claim 11, wherein the intermediate electrode contacts the second substrate.

19. The plasma display panel according to claim 1, wherein the address electrode contacts the first substrate.

20. A plasma display panel comprising:

at least one discharge cell; and a pair of substantially parallel elongate display electrodes, at least a portion of each which is disposed above the at least one discharge cell, wherein each of the display electrodes comprises:

a transparent electrode extending over the at least one discharge cell;

an elongate main bus electrode in electrical contact with the transparent electrode comprising an elongate axis substantially parallel with elongate axes of the display electrodes; and means, in electrical and physical contact with the transparent electrode, for reducing a voltage drop over the transparent electrode.

21. A plasma display comprising:

a discharge cell; and a first pair of display electrodes, wherein at least one of the first pair of display electrodes comprises:

a transparent electrode comprising a back edge proximal to a wall of a discharge cell, a front edge proximal to the other of the pair of display electrodes, and a face proximal to the discharge cell;

a main bus electrode extending in the second direction, disposed at or near the back edge of the transparent electrode, and in electrical contact with the transparent electrode; and a sub-bus electrode extending in the second direction, physically contacting the transparent electrode at or near the front edge of the transparent electrode, and in electrical contact with the transparent electrode.

* * * * *